US006736127B2

(12) United States Patent
Steckling

(10) Patent No.: US 6,736,127 B2
(45) Date of Patent: May 18, 2004

(54) INLINE PITCHING SYSTEM

(76) Inventor: Joseph M. Steckling, 915 2nd St., North, Sauk Rapids, MN (US) 56379

( * ) Notice: Subject to any disclaimer, the term of this patent is extended or adjusted under 35 U.S.C. 154(b) by 133 days.

(21) Appl. No.: 10/062,012

(22) Filed: Jan. 31, 2002

(65) Prior Publication Data

US 2003/0140916 A1 Jul. 31, 2003

(51) Int. Cl.[7] ..... B28D 1/26
(52) U.S. Cl. ..... 125/23.01; 125/3
(58) Field of Search ..... 125/23.01, 3, 2; 451/41, 44, 57

(56) References Cited

U.S. PATENT DOCUMENTS 2,958,163 A * 11/1960 Cammerzell, Jr. ..... 125/23.01
3,067,731 A * 12/1962 Potter et al. ..... 125/3
3,213,510 A * 10/1965 Mizer et al. ..... 451/195
3,292,310 A * 12/1966 Lefevre ..... 451/269

FOREIGN PATENT DOCUMENTS

GB 003907 * 10/1876 ..... 125/3
GB 005283 * 4/1915 ..... 125/2

* cited by examiner

*Primary Examiner*—Robert A. Rose
(74) *Attorney, Agent, or Firm*—Jacobson & Johnson

(57) ABSTRACT

An inline apparatus and method for processing an unworked masonry article to produce a decorative masonry article having pitched face edges located in a non-parallel relationship to each other. The inline apparatus includes a conveyor line for carrying the masonry article, a pitching machine for pitching at least one of the frontal face edges of the masonry article, a flipping machine for repositioning the masonry article while the masonry article is in the conveying line and a second pitching machine for processing at least one additional face edge which is located in a non-parallel condition to the face edge of masonry article that has been pitched.

16 Claims, 5 Drawing Sheets

INLINE PITCHING SYSTEM

FIELD OF THE INVENTION

This invention relates generally to creating decorative faces on masonry articles and more particularly to an inline system that pitches the edges of masonry articles in one continuous operation.

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

In order to provide a decorative face to a masonry articles such as a concrete, stone or clay block the four frontal face edges of the masonry article can be removed with a hammer and chisel or with a machine operated hammer head. Done properly, with either a machine or by a stone mason, the result is a masonry article with a hand chiseled masonry appearance that is pleasing to the eye. The process of removing the face edges of a masonry article to produce a decorative effect is known in the art as "pitching". Typically, the masonry articles that are pitched can vary in size from hand placeable rectangular bricks to huge stone blocks that require machines to lift and place the stone blocks in place.

In order to more quickly chisel the face edges of a masonry article it is preferred to use a pitching machine having a pair of rotating hammer heads that strikingly remove the face edge of the masonry article by repeatedly striking the face edges of the masonry articles along the entire length of the face edge. The swinging hammer heads can quickly chip away the rectangular shaped face edge producing a decorative hand chiseled effect.

In machine pitching the masonry article is placed in a pitching machine where two parallel face edges on the masonry article are struck sufficiently hard to chip away the frontal edge to produce a decorative frontal face on the masonry article. The result is a decorative frontal edge along two opposite but parallel face edges of the masonry article. Oftentimes an architect wants to have all four frontal face edges of the masonry article removed to produce the desired decorative effect. In order to pitch all four face edges where two of the edges are perpendicularly to the others requires the masonry article to be removed from the pitching machine and the pitching process repeated on the remaining face edges of the masonry articles that are perpendicular to the pitched parallel face edges.

The present invention comprises a method and apparatus for inline processing a masonry article so that a masonry article having no pitched edges can be placed on one end of a conveyor and when the masonry article emerges from the opposite end of the conveyor all four of the face edges of the masonry article are pitched to thereby prove a masonry article with an elegant hand chiseled appearance that is in a condition ready to be transported to a work site.

SUMMARY OF THE INVENTION

An inline apparatus and method for processing a masonry article to produce a masonry article having pitched edges along face edges located in a non-parallel relationship to each other. The inline apparatus includes a conveyor line for carrying the masonry article, a pitching machine for pitching at least one of the frontal face edges of the masonry article, a flipping machine for repositioning the masonry article while the masonry article is in the conveying line and a second pitching machine for processing at least one additional face edge, which is located in a non-parallel condition to the face edge of masonry article that has been pitched.

DESCRIPTION OF THE PREFERRED EMBODIMENT

Figure 1:
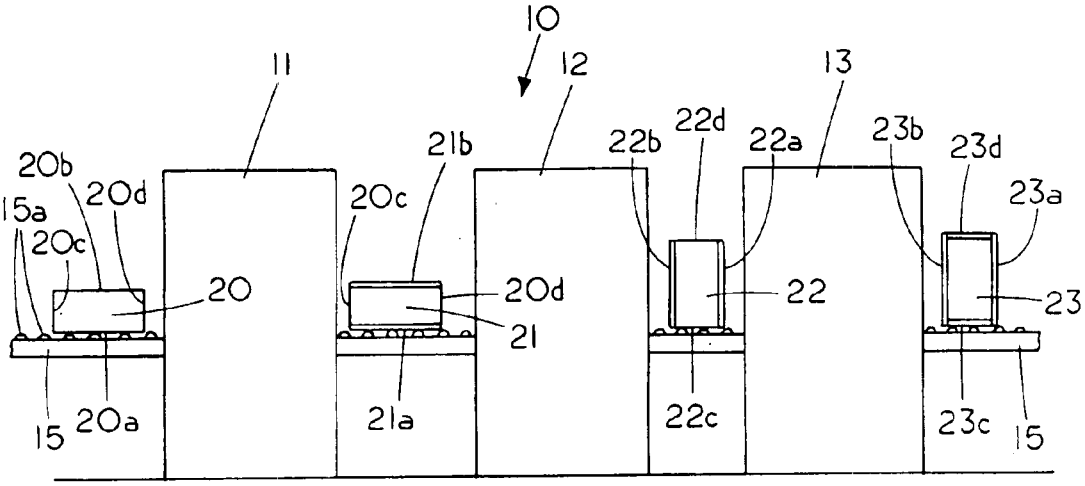
FIG. 1 is a front view of an inline system for pitching all four face edges of a masonry article as the masonry article is carried by a conveyor.

FIG. 1 shows a front view of an inline system 10 for pitching all four face edges of a masonry article as the masonry article is carried by a conveyor 15. The inline system 10 includes a first pitching station 11 for removing a first face edge of a masonry article, a flipping station 12 for reorienting the masonry article and a second pitching station 13 for removing a second face edge of a block that is non-parallel to the first face edge. The conveyor, which 15 extends through each of the stations carries the masonry article from station to station.

In operation of the inline system 10 a masonry article 20 is carried by conveyor 15 which has a set of end supported rollers 15*a* thereon that allow the masonry article to be supported and transported from station to station in system 10. A first masonry article 20 is shown in an unworked condition and having frontal face edges 20*a*, 20*b*, 20*c* and 20*d*, which have, square corners. Masonry article 20 is about to enter pitching station 11.

Located on conveyor 15 is a second masonry article 21 in a partially worked condition that has been discharged from pitching machine 11. Masonry article 21 has a first top frontal face edge 21*b* that has been removed as well as a second bottom frontal face edge 21*a* that has also been removed by the pitching machine in station 11. Thus, the masonry article 21 is shown with two parallel frontal face edges removed to produce a decorative effect. Masonry article 21 is carried by conveyor 15 and is ready to be transported into flipping station 12.

Located on conveyor 15 and between station 12 and pitching station 13 is a third masonry article 22 that has been transported from flipping station 12 by conveyor 15. Masonry article 22 is shown in an end orientation while masonry articles 20 and 21 are shown in a side orientation. As the masonry article 22 passes through the flipping station 12 the masonry article is reoriented from a side orientation, as illustrated by masonry article 21, to an end orientation. In this condition the pitched face edges 22*a* and 22*b* are now in a condition perpendicular to the conveyor line while the unpitched face edged 22*c* and 22*d* are in a condition parallel to the conveyor line 15. Masonry article 22 is carried by conveyor 15 and is ready to be transported into pitching station 13.

Located on conveyor 15 and after pitching station 13 is a third masonry article 23 that has been transported from pitching station 13 by conveyor 15. Masonry article 23 emerges from pitching station 13 with both the top frontal face edge 23*d* and the bottom frontal face edge 23*c* pitched to produce a masonry article 23. Thus all the frontal face edges of the masonry article 23 have been pitched to produce a masonry article with a decorative face.

Figure 2:
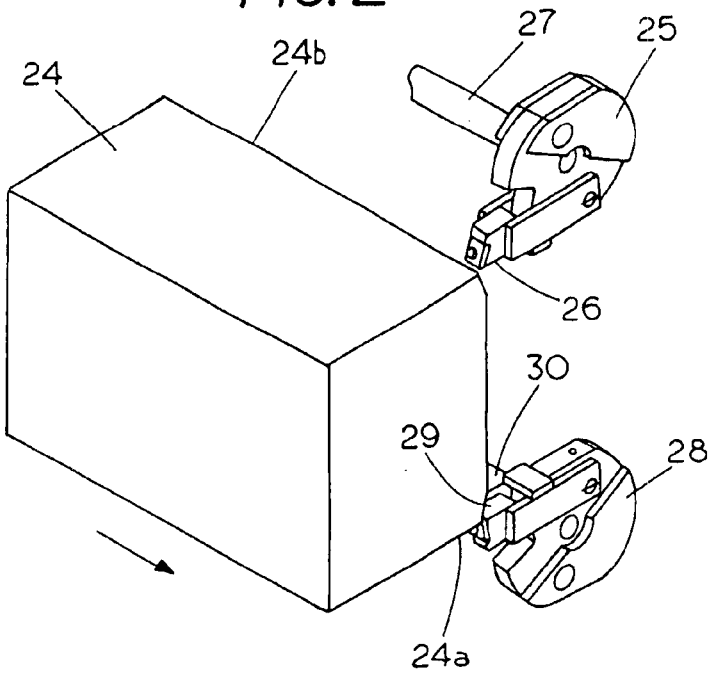
FIG. 2 is an isolated view of a masonry article and a set of rotating hammer heads for simultaneously pitching opposite face edges of a masonry article as the masonry article is carried along a conveyor.

FIG. 2 reveals a portion of the interior of pitching station 11 and a masonry article 24 carried through the pitching station by conveyor 15 (FIG. 1). To understand the operation of the pitching station the components for pitching the face edge of a masonry article, the masonry articles are shown in an isolated view in FIG. 2. FIG. 2 shows masonry article 24 and a first rotating hammer head 26 and a second rotating hammer head 29 for simultaneously pitching opposite face edge 24*a* and face edge 24*b* of masonry article 24 as the masonry article is carried along a conveyor. Hammer head 26 is pivotally held on disk 25 which is driven by a counter clockwise rotatable shaft 27. Similarly, hammer head 29 is pivotally held on disk 28, which is driven in a clock wise direction by rotatable shaft 30. In operation the block 24 is transported in the direction of the arrow by conveyor 15 (FIG. 1) as the hammer head 26 chips away the top face edge 24*b* and the hammer head 29 chips away the parallel bottom face edge 24*a* which results in a masonry article with two pitched edges. While two face edges are shown as being simultaneously pitched in pitching station 11, if desired only one face edge could be pitched by disengaging one of the hammer heads.

Once the first face edge of the masonry article is pitched the remaining non-parallel face edges of the masonry article can be pitched. Since the pitching process occurs as the blocks move laterally along the conveyor it is desired to maintain the blocks in an orientation where the unworked face edges are located parallel to the direction of the conveyor. This requires a flipping of the masonry article to complete the further processing.

Figure 3:
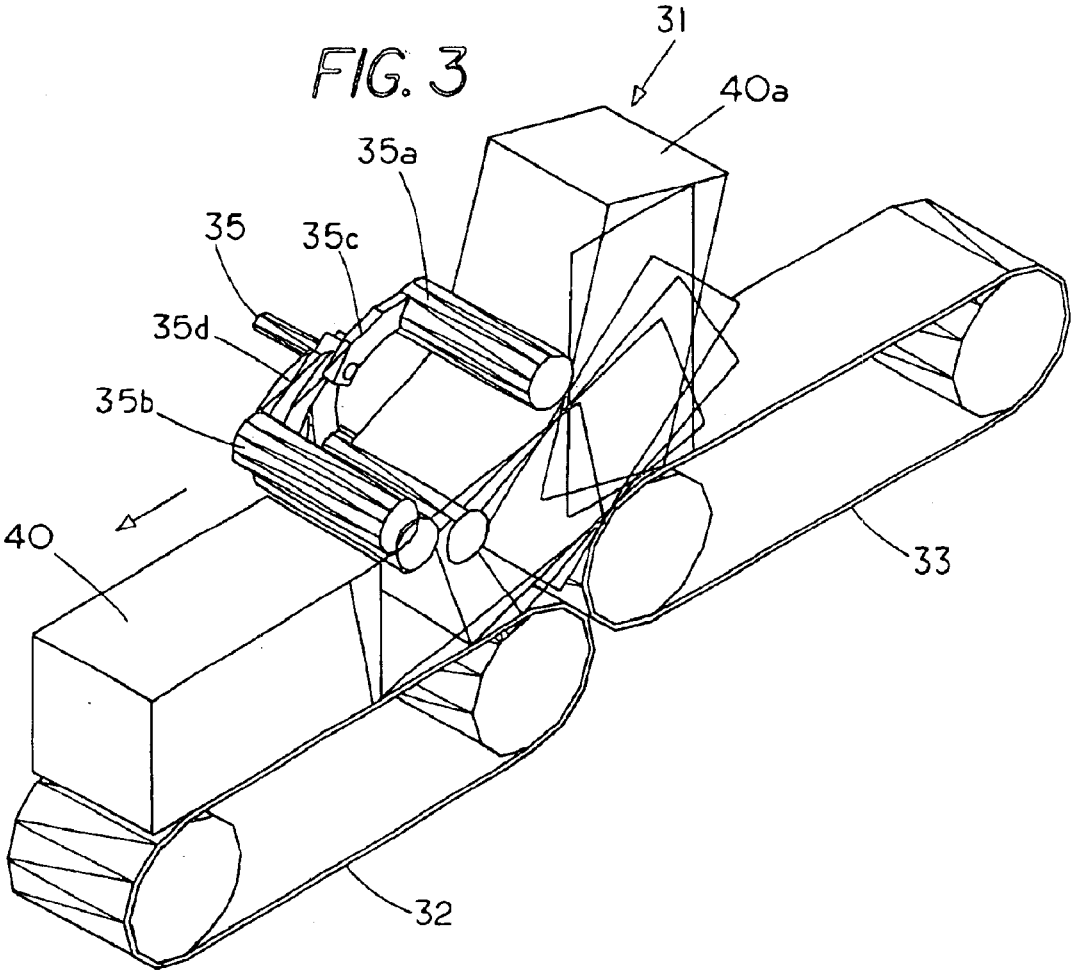
FIG. 3 is a partial schematic view of an inline flipping mechanism for rotating a masonry article from a first orientation to a second orientation.
Figure 4:
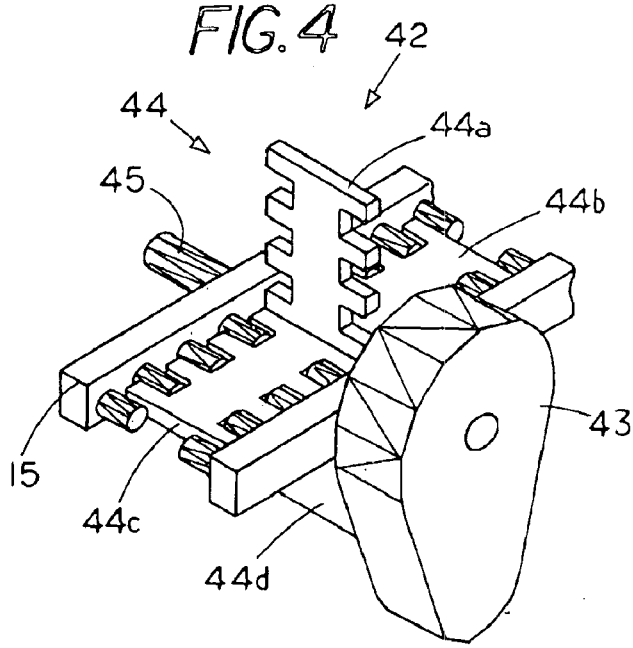
FIG. 4 is an isolated view of an inline flipping mechanism in a ready position for receiving a masonry article.

FIG. 3 is a partial schematic view of an inline flipping mechanism 31 for rotating a masonry article from a first orientation to a second orientation. Multiple outlines of the position of the front face of the masonry article are shown to illustrate how the masonry article is reoriented from a vertical orientation to a horizontal orientation. Flipping mechanism 31 is located in a flipping station and reorients a masonry article from an end condition to a side condition. Flipping mechanism 31 which is located in a flipping station includes a first belt conveyor 33 for propelling masonry article 40 laterally in the direction of the arrow. As masonry article 40 moves in a lateral direction the leading end of the masonry article 40 is tipped downward by a pair of resilient held roller 35*a* and 35*b* which are supported by arms 35*c* and 35*d* that extend to shaft 35. Rollers 35*a* and 35 maintain tipping pressure and support on masonry article to prevent the masonry article 40 from falling over as it is set on end on conveyer 32. Maintaining rolling pressure on the masonry article 40 supports the masonry article as it is gradually reoriented from the vertical orientation shown on conveyor 33 to the horizontal orientation shown on conveyor 32. Although end supported rollers can be used FIG. 4 illustrates belt conveyor 32 and 33 as part of an inline system. The belt conveyor can be positioned so as to mate with the roller conveyor 15. Thus with the illustrated flipping mechanism 31 a masonry article can be reoriented from a vertical end condition to a horizontal condition without human intervention.

FIG. 4 shows an isolated view of an inline flipping mechanism 42 in a ready position for receiving a masonry article. Flipping mechanism 42 forms part of the conveyor line 15 and includes a four flipping member 44 comprising a first paddle-like, flipping arm 44*a*, a second paddle-like, flipping arm 44*b*, a third paddle-like, flipping arm 44*c* and a fourth paddle-like, flipping arm 44*d* that are located in perpendicular arrangement to proximate flipping arms and are connected to shaft 45. A drive member 43 periodically rotates shaft 45 to rotate the flipping arm 90 degrees from one position to another position.

Figure 5:
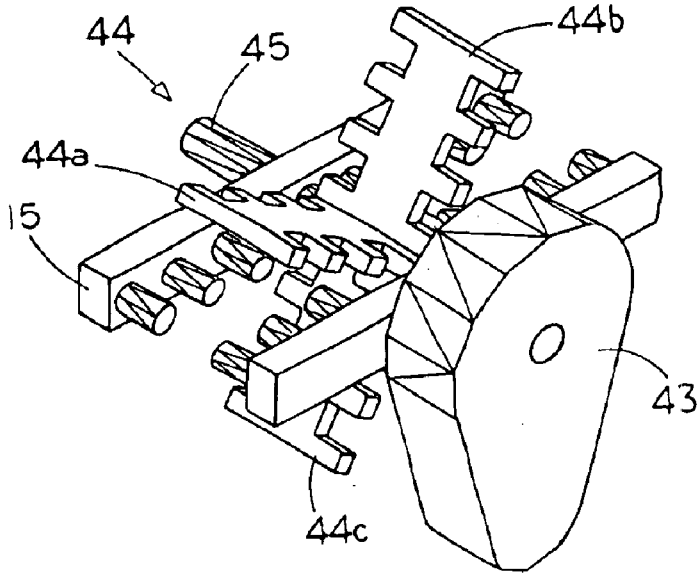
FIG. 5 is an isolated view of the inline flipping mechanism of FIG. 4 illustrating the rotation of the arms during the flipping process.

FIG. 5 is an isolated view of the inline flipping mechanism 44 of FIG. 4 illustrating the rotation of the flipping arms during the flipping process. That is, arm 44*c* has been rotated counter clockwise past the stub rollers on conveyor 15 while the arms 44*a* is rotated from the vertical end condition downward toward a horizontal orientation which also brings arm 44*b* toward a vertical end condition. In order to illustrate the flipping action reference should be made to FIG. 6.

Figure 6:
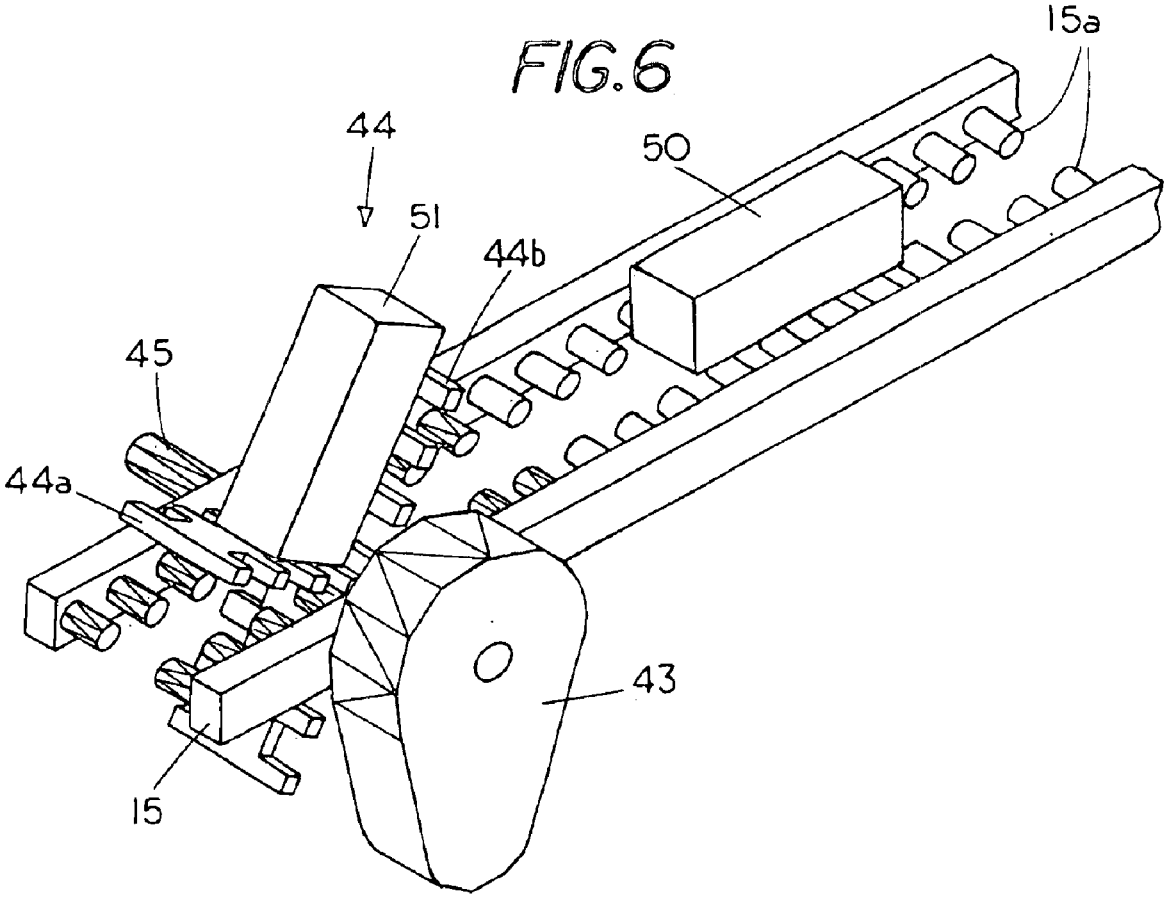
FIG. 6 shows the inline flipping mechanism of FIG. 4 in the process of flipping a masonry article from a first orientation to a second orientation as the masonry article is carried by a conveyor.

FIG. 6 shows the inline flipping mechanism of FIG. 4 in the process of flipping a masonry article 51 from a first orientation to a second orientation as the masonry article is carried by a conveyor 15. In operation of the flipping mechanism a masonry article is transported laterally along stub rollers 15*a* on conveyer 15. FIG. 6 shows that a masonry article that has been transported laterally along stub rollers 15*a* until the end of masonry article 51 engages arm 44*a*. When this end condition occurs a signal is sent to rotate shaft 45 counter clockwise which begins to rotate masonry article 51 from the horizontal orientation on conveyor 15 to a vertical end orientation as the masonry article is discharged from flipping mechanism 44. Once the reorientation is completed the masonry article continues to be transported along conveyer 15 by the rollers 15*a*.

Figure 7:
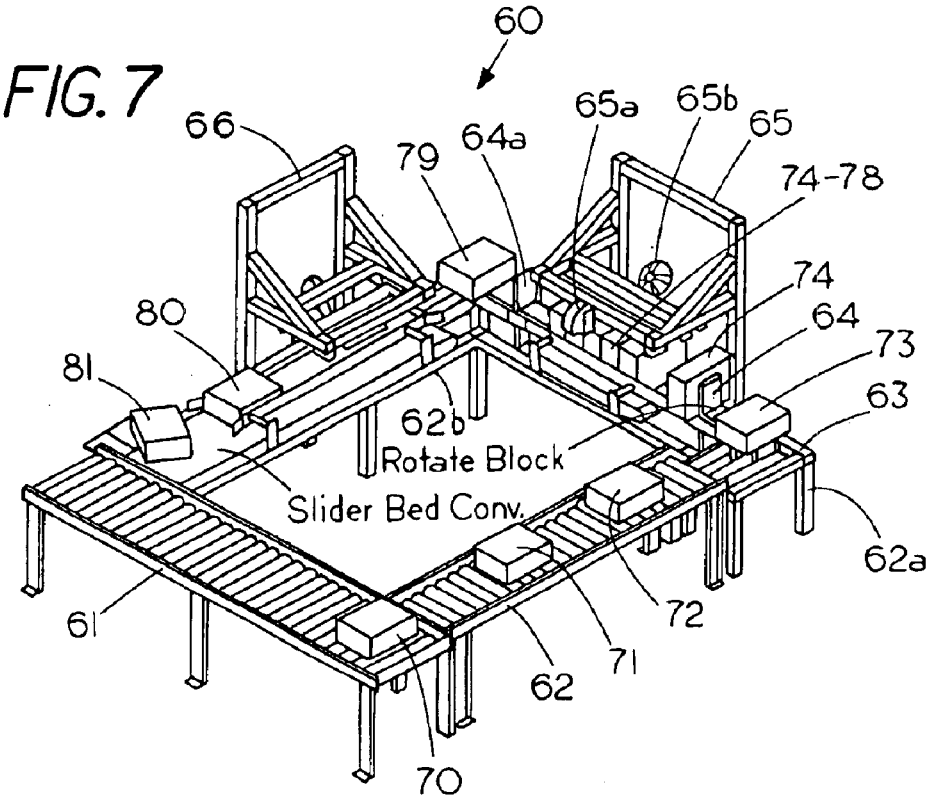
FIG. 7 shows a schematic perspective view of an offset inline conveyor system where a masonry article is removed from a first main conveyor line and is pitched as the masonry article travels along a second conveyor line and then returned to the main conveyer line.

FIG. 7 shows a schematic perspective view of an offset inline conveyor system where a masonry article is removed from a first main conveyor line and is pitched as the masonry article travels along a second conveyor line and then returned to the main conveyer line. A first conveyor 61 support's a masonry article 70 as it is transported laterally therealong. The masonry article 70 can be transferred to conveyor 62 by a push arm (not shown). Conveyor 62 is shown transporting a first masonry article 71 and a second masonry article to an end conveyor 62*a* which is positioned perpendicularly to conveyor 62. Conveyor 62*a* includes a flipping station 64 that flips a masonry article from a horizontal to a vertical orientation. Masonry article 74 is shown in the vertical orientation. A pitching station 65 includes a first rotating hammer head 65*a* and a second rotating hammer head 65*b* for pitching the top face edges of masonry articles 74–78 which are located in a side by side end condition in pitching machine 65. Thus a plurality of masonry articles can be pitched at a same time. As the article leaves the pitching machine a flipping mechanism 64*a* reorientates the masonry article from a vertical orientation to a horizontal orientation. Next, a conveyer 62*b* transports the masonry articles through a second pitching station 66. A masonry article 79 is shown on conveyor 62*b* and about to enter pitching station 66 where a set of hammer heads (not shown) pitch the face edges on a masonry article located therein. Once completed the masonry article discharges from pitching station 66 as illustrated by masonry article 80. Next a rotating table 81 can rotate the masonry article to position for delivery to a work site.

With the system shown in FIG. 7 one can orient both side face edges and end face edges of a masonry article for pitching. This feature is useful for masonry articles that require pitching on end face edges as well as frontal face edges. For example, in corner blocks that have two exposed decorative faces.

Figure 8:
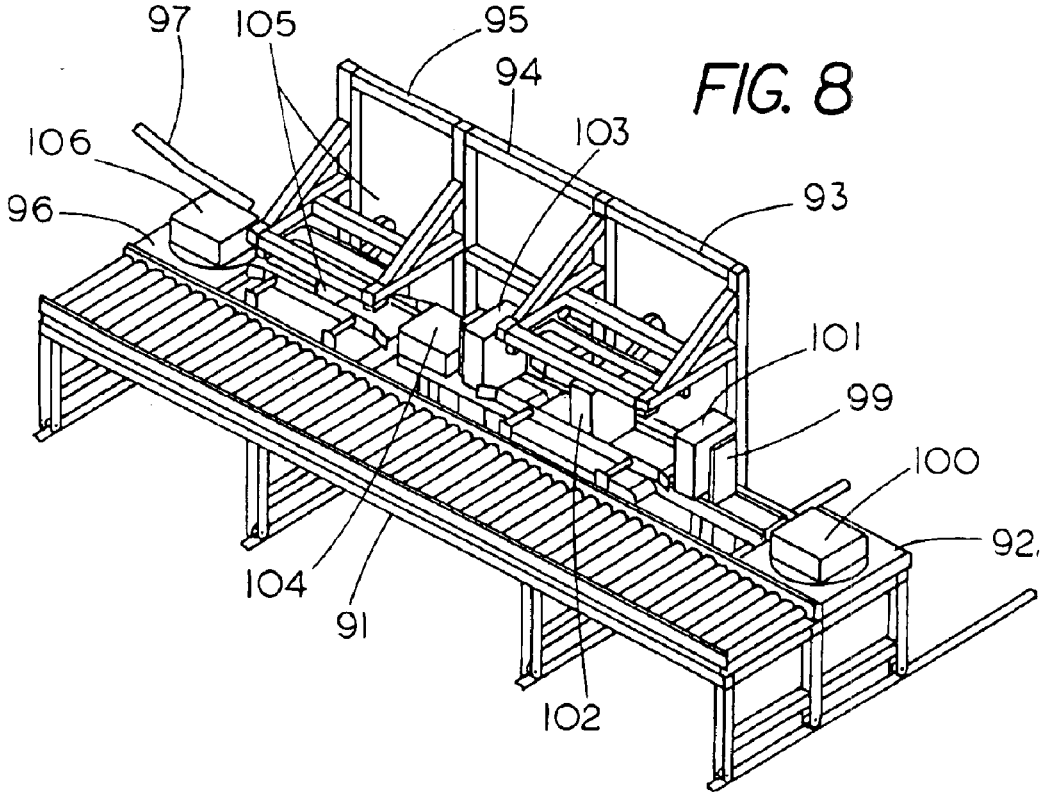
FIG. 8 shows a perspective view of an inline conveyor system where the system includes multiple flipping mechanisms for reorienting the position of the masonry article.

FIG. 8 shows a perspective view of a side by side an inline conveyor system where the masonry articles includes multiple flipping mechanisms for reorienting the position of the masonry article. A first conveyor line 51 extends in a side by side relationship to the inline system for pitching a masonry article. In operation of the system of FIG. 8 an arm (not shown) pushes an unworked masonry article 100 from conveyer 91 to turn table 92. The masonry article then enters flipping mechanism 99. A masonry article 101 is shown in the reoriented end condition. The masonry article then enters a pitching station 93 and then passes through a second flipping station 94 and a further pitching station 95 from where it exits to a turning station 96. A push arm 97 now pushes the finished masonry article 106 back onto the conveyer line 104 for delivery to the work site.

Figure 9:
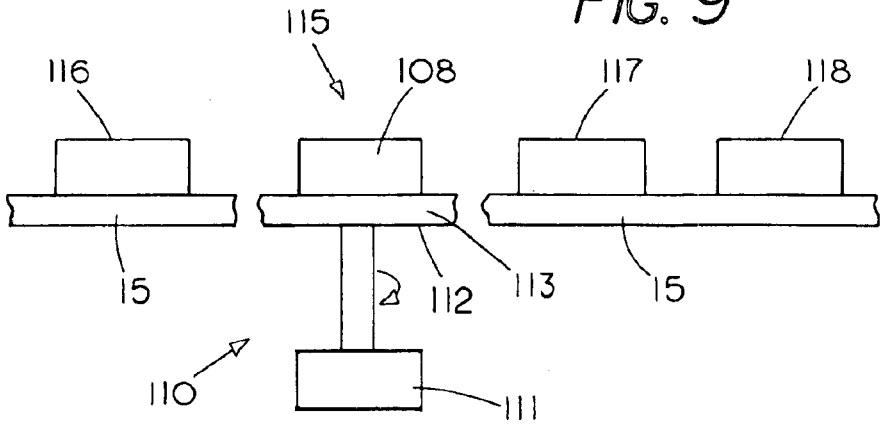
FIG. 9 shows a front view of an inline conveyor with a flipping mechanism to rotate a masonry article from a first orientation to a second orientation by temporarily isolating the masonry article from the conveyor line and then returning the masonry article to the conveyor line.

FIG. 9 shows a front view of an inline conveyor with a flipping mechanism to rotate a masonry article from a first orientation to a second orientation by temporarily isolating the masonry article from the conveyor line and then returning the masonry article to the conveyor line. A masonry article 108 is shown supported by table 113 which is supported by shaft 112 that is pivotally supported by a drive member 111. In operation of the flipping mechanism 115 the table 113 which supports masonry article 108 can be rotated to reorientate the masonry articles. FIG. 9 illustrates masonry article 116 in a frontal orientation before entering flipping station 115 and masonry articles 117 and 118 which have been discharged from flipping station 115 in an end orientation.

Figure 10:
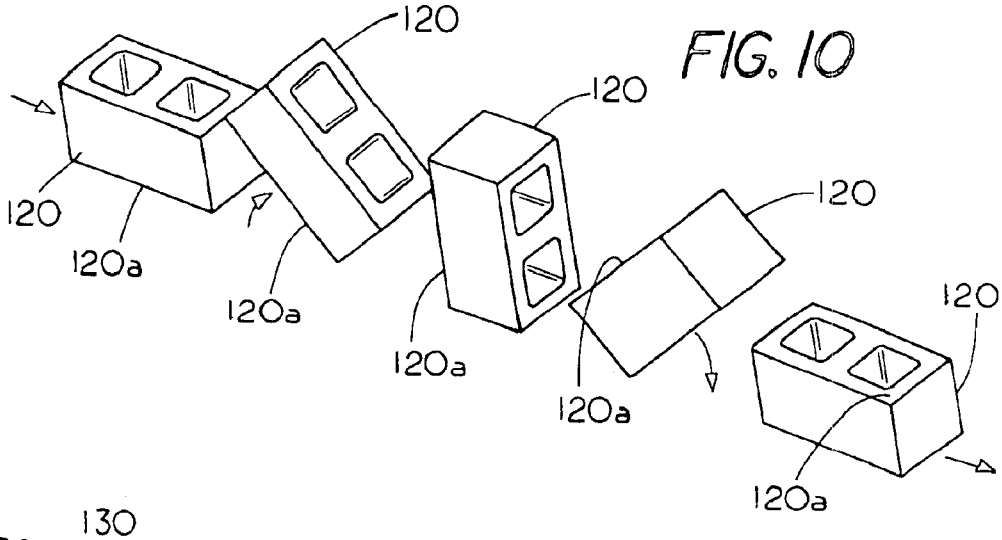
FIG. 10 is a schematic perspective view illustrating the sequential flipping operation of an inline system with the flipping sequence illustrating a masonry article reoriented from a horizontal to a vertical condition and than from a vertical condition to a forward horizontal condition to complete a 180 degree change in the orientation of the masonry article.

FIG. 10 is a schematic perspective view illustrating the sequential flipping operation of an inline system with the flipping sequence illustrating a masonry article 120 reoriented from a horizontal to a vertical condition and than from a vertical condition to a forward horizontal condition to complete a 180 degree change in the orientation of the masonry article. To illustrates the flipping action performed by the present method one edge 120*a* of the he masonry article 120 is identified in each view of the masonry article. As the masonry article proceeds from left to right note that the face edge 120*a* starts out on the bottom and ends up on the top in the final view of masonry article 120. Thus the present invention includes method and apparatus for rotating a masonry article from a first orientation to a second orientation which is 180 degrees opposite from the first orientation.

Figure 11:
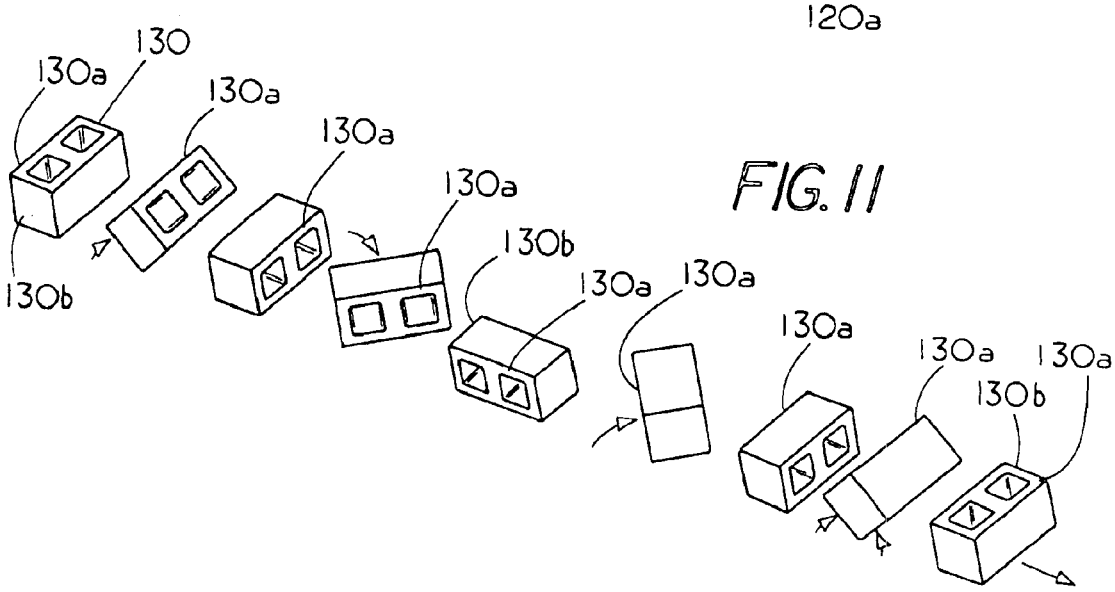
FIG. 11 is a schematic perspective view illustrating the flipping sequence of an inline system where a masonry article is reoriented from a first end position to a first side position, next the masonry article is rotated 90 degrees which is followed by a second 90 degree rotation which places the back end of the block toward the front which is followed by a reorientation of the masonry article to an end position that is a 180 degree change in the orientation of the masonry article as well as having the back face of the masonry article oriented toward the direction that the front face of the masonry article faced at the beginning of the inline flipping sequence.

FIG. 11 is a schematic perspective view illustrating the flipping sequence of an inline system where a masonry article is reoriented from a first end position to a first side position, next the masonry article is rotated 90 degrees which is followed by a second 90 degree rotation which places the back end of the block toward the front which is followed by a reorientation of the masonry article to an end position that is 180 degree change in the orientation of the masonry article as well as having the back face of the masonry article oriented toward the direction that the front face of masonry article faced at the beginning of the inline flipping sequence. To illustrate what happens to a masonry article 130 a top edge 130*a* and a front end 130*b* are identified in the left end of the sequence of masonry articles. As the views of the masonry articles proceed from left to right one notes the face edge 130*a* and the end face 130*b* change orientation. In the final view of the masonry article 130 the end face 130*b* which stared out in the front is now in the back and the face edge 130*a* which was the left face edge is now the right face edge of the masonry article. Thus the masonry article has been reoriented to enable the processing of selected face edges as well as to bring the finished masonry article to an end condition where it is ready to be shipped to a site with the orientation of the masonry article in the desired orientation for the contractor.

Thus the present invention comprises a method of inline forming a decorative face on a masonry article comprising the steps of 1) supporting the masonry article on a first face; 2) propelling the masonry article into a first pitching machine; 3) pitching at least one face edge on the masonry article; 4) propelling the masonry article on a first face to a flipping device; 5) flipping the masonry article onto a second face with the masonry article being supported on the second face; 6) propelling the masonry article into a second pitching machine; 7) pitching at least one additional face edge of the masonry article while the masonry article is supported on the second face; and 8) propelling the masonry article having at least two pitched face edges out of the second pitching machine to enable transfer of the masonry article to a work site. Thus the present invention allows one to remove the rectangular corner edge from a masonry article without having to handle the masonry articles.

While a single rotating hammer head is shown it should be understood that one or more hammer heads could be used. While the applicant describes the movement of the material through a pitching machine with rotating hammers it should be understood that the pitching heads could be can activated chisels or pressure activated chisels that move with the masonry article as the article moves through a pitching station in either a synchronous or a non-synchronous mode. In addition although a horizontal inline apparatus is shown the inline apparatus could also move in other directions including vertical.

I claim:

1. A method of inline forming a decorative face on a masonry article comprising:

supporting the masonry article on a first face;

propelling the masonry article into a first pitching machine;

pitching at least one face edge on the masonry article;

propelling the masonry article on the first face to a flipping device;

flipping the masonry article onto a second face with the masonry article being supported on the second face;

propelling the masonry article into a second pitching machine;

pitching at least one additional face edge of the masonry article while the masonry article is supported on the second face; and propelling the masonry article having at least two pitched face edges out of the second pitching machine to enable transfer of the masonry article to a work site.

2. The method of inline forming a decorative face on a masonry article of claim 1 wherein each of the step of pitching comprises striking of the masonry article with a swingable hammer.

3. The method of inline forming a decorative face on a masonry article of claim 1 wherein the pitching of the at least one additional face of the masonry article comprises pitching the at least one additional face edge that is located in a non-parallel condition with respect to the at least one face edge of the masonry article.

4. The method of inline forming a decorative face on a masonry article of claim 3 including the step of pitching at least two mutually perpendicular face edges of the masonry article.

5. The method of inline forming a decorative face on a masonry article of claim 1 including the step of flipping the masonry article after pitching the additional face edge to reorienting the masonry article for transport to a work site.

6. The method of inline forming a decorative face on a masonry article of claim 1 wherein the step of flipping comprises using an arm to rotate the masonry article from a first orientation to a second orientation.

7. The method of inline forming a decorative face on a masonry article of claim 1 including the step of pitching at least four face edges on the masonry article.

8. The method of inline forming a decorative face on a masonry article of claim 1 comprising directing the masonry article from a primary conveyor line and onto the conveyor line and then returning the masonry article to the primary conveyor line.

9. The method of inline forming a decorative face on a masonry article of claim 1 including the step of simultaneously pitching at least two face edges of the masonry article in each of the pitching machines.

10. An inline pitching system comprising:

a first pitching station;

a second pitching station;

a first flipping station, said first flipping station positioned between said first pitching station and said second pitching station a second flipping station comprising a rotating table; and a conveyor extending thorough said first pitching station and said second pitching station to enable a masonry article to be placed on the conveyor and carried through the first pitching station in a first orientation to enable pitching of a first face edge of the masonry article, said flipping station rotating said masonry article from the first orientation to a second orientation to enable the conveyor to carry the masonry article through the second pitching station in the second orientation to enable further pitching thereof.

11. An inline pitching system comprising:

a first pitching station;

a second pitching station;

a first flipping station, said first flipping station positioned between said first pitching station and said second pitching station; and a conveyor extending thorough said first pitching station and said second pitching station to enable a masonry article to be placed on the conveyor and carried through the first pitching station in a first orientation to enable pitching of a first face edge of the masonry article, said flipping station comprising a rotatable arm for rotating said masonry article from the first orientation to a second orientation to enable the conveyor to carry the masonry article through the second pitching station in the second orientation to enable further pitching thereof.

12. The inline pitching system of claim 10 wherein the second flipping station is located after said second pitching station.

13. The inline pitching system of claim 10 including at least one swingable hammer head in said first pitching station and at least one swingable hammer head located in said second pitching station.

14. The inline pitching system of claim 10 wherein each of the pitching stations includes two hammer heads to simultaneously remove parallel face edges from the masonry article.

15. The inline pitching system of claim 10 wherein the conveyor comprises a roller conveyor.

16. The inline pitching system of claim 10 wherein the second flipping station includes a set of pressure rollers for repositioning the masonry article from a vertical end upright position to a horizontal position.

* * * * *